US011851860B2

(12) United States Patent
Keel et al.

(10) Patent No.: US 11,851,860 B2
(45) Date of Patent: Dec. 26, 2023

(54) JET REGULATOR

(71) Applicant: KWC AG, Hergiswil (CH)

(72) Inventors: Manuel Keel, Wildegg (CH); Reto Berger, Neuenhof (CH); Andreas Rueegg, Hildisrieden (CH)

(73) Assignee: KWC AG, Unterkulm (CH)

( * ) Notice: Subject to any disclaimer, the term of this patent is extended or adjusted under 35 U.S.C. 154(b) by 580 days.

(21) Appl. No.: 16/914,676

(22) Filed: Jun. 29, 2020

(65) Prior Publication Data

US 2020/0407955 A1 Dec. 31, 2020

(30) Foreign Application Priority Data

Jun. 27, 2019 (DE) ..... 102019117381.7

(51) Int. Cl.
*E03C 1/084* (2006.01)
*E03C 1/04* (2006.01)
*E03C 1/08* (2006.01)

(52) U.S. Cl.
CPC ..... *E03C 1/084* (2013.01); *E03C 1/0411* (2013.01); *E03C 1/08* (2013.01)

(58) Field of Classification Search
CPC ..... E03C 1/0411; E03C 1/08; B05B 1/3402; B05B 1/3405; B05B 1/3431; B05B 1/341; B05B 1/3415; B05B 1/3421; B05B 1/3426; B05B 1/3484
USPC ..... 239/424, 428.5; 4/676
See application file for complete search history.

(56) References Cited

U.S. PATENT DOCUMENTS 3,275,248 A * 9/1966 O'Brien ..... B05B 1/12 239/487
3,920,187 A * 11/1975 Willis ..... B05B 1/3405 239/419
4,077,545 A * 3/1978 Karls ..... F24H 1/102 137/341
5,143,295 A * 9/1992 Okayama ..... B05B 3/04 239/432
9,623,426 B2 4/2017 Schurle

FOREIGN PATENT DOCUMENTS

| | | |
|---|---|---|
| CH | 657403 | 8/1986 |
| DE | 202013002283 | 7/2014 |
| DE | 102017001151 | 8/2018 |
| GB | 2104625 | 3/1983 |

* cited by examiner

*Primary Examiner* — Jason J Boeckmann
(74) *Attorney, Agent, or Firm* — Volpe Koenig

(57) ABSTRACT

A jet regulator for a fitting for dispensing boiling water is provided. The jet regulator includes a substantially cylindrical housing with an inlet opening and an outlet opening, and a swirl creating portion, arranged in the region of the inlet opening, with a substantially helically extending flow guide for rotationally accelerating a stream of water flowing through, an expansion zone, following the swirl creating portion, in which the rotationally accelerated stream of water can flow under the action of centrifugal force in the region of the housing inner wall, and a guide portion, in which the rotational movement of the stream of water is decelerated and the latter is guided in a longitudinal direction.

13 Claims, 5 Drawing Sheets

JET REGULATOR

INCORPORATION BY REFERENCE

The following documents are incorporated herein by reference as if fully set forth: German Patent Application No. DE 10 2019 117 381.7, filed Jun. 27, 2019.

TECHNICAL FIELD

The present invention relates to a jet regulator for a fitting.

BACKGROUND

A jet regulator is attached to the outflow of a faucet and serves to form the water jet. It is therefore definitively responsible for the perceptible properties of the emerging water jet and is intended, inter alia, to prevent spraying when the water jet emerges.

Known on the market are, inter alia, also fittings that, in addition to normal mixed water (hot/cold), can also dispense boiling water. For this purpose, boiling hot water is stored under pressure in a water heater and can be dispensed via the fitting. Upon emerging from the outflow of the fitting, the boiling hot water expands, such that the water emerges ideally in a bubbling hot form. The gas (steam) that arises upon the relaxation of the boiling hot water has the effect, however, that the water jet emerges unevenly and with a large amount of spray. This cannot be prevented by conventional jet regulators. In order to prevent spraying of the boiling hot water upon emerging, the temperature of the water has to be lowered, this being undesired in a fitting for providing boiling hot water, however.

SUMMARY

Therefore, it is an object of the invention to specify a jet regulator that is suitable for dispensing boiling water.

The object is achieved by a jet regulator with one or more features of the invention. Advantageous configurations can be found below and in the claims.

Provided according to the invention in a jet regulator for a fitting for dispensing boiling water, said jet regulator having a substantially cylindrical housing with an inlet opening and an outlet opening, are a swirl creating portion, arranged in the region of the inlet opening, with a substantially helically extending flow guide for rotationally accelerating a stream of water flowing through, an expansion zone, following the swirl creating portion, in which the rotationally accelerated stream of water can flow under the action of centrifugal force in the region of the housing inner wall, and a guide portion, in which the rotational movement of the stream of water is decelerated and the latter is guided in a longitudinal direction.

When the rotationally accelerated water jet emerges from the swirl creating portion, the relaxation (pressure drop) takes place and the water evaporates—gaseous steam emerges. Due to the action of centrifugal force, the fluid remains close to the housing inner wall in the subsequent expansion zone and the emerging gas is pushed inward. As a result of this cyclone effect, there is thus fluid/gas separation, and the gas phase can be discharged or emerge separately via the inner region. On account of the fluid/gas separation, the speed at which the water jet emerges can be reduced considerably. Gas bubbles no longer arise in the end region of the jet regulator, with the result that the water jet sprays much less.

Tests by the applicant have furthermore led to the surprising finding that the jet regulator according to the invention is also highly suitable for dispensing water enriched with carbon dioxide ("sparkling water"). When such carbon dioxide-containing water is dispensed, gas in the form of $CO_2$ emerging from the water likewise arises during expansion. Here, however, compared with the fluid/gas separation in the case of boiling water, there is an opposite requirement, namely that of keeping the escape of $CO_2$ as low as possible such that more $CO_2$ dissolved in the water arrives in the user's drinking vessel. Here, it has now been found that the pressure drop in the swirl creating portion takes place in a very gentle manner for the $CO_2$ dissolved in the water, with the result that the $CO_2$ content in the sparkling water can be increased by about 30% according to tests by the applicant.

It has also proven to be particularly advantageous that the jet regulator according to the invention can be constructed in a particularly compact manner. For a flowrate of at least 2.5 to 3 l/min at about 105° C., the jet regulator according to the invention can be designed with an outside diameter of only between 11 and 13 mm. This makes it possible in particular to use the jet regulator as an internal jet regulator in a concentric arrangement of a multifunctional fitting, in which a further, separate water dispensing opening for example for service water or mixed water can be arranged in an outer ring around the inner jet regulator.

In one development of the present invention, the jet regulator has a laminar jet regulator portion arranged in the region of the outlet opening, said laminar jet regulator portion being configured to dispense the stream of water as a laminar jet. Such a laminar jet regulator, which can be used here in combination with the abovementioned cyclone design, is well known for conventional fittings. Such a laminar jet regulator portion can be formed for example by a multiplicity of flow channels that are arranged next to one another and extend in an axial direction. The laminar water jet flows out through this outlet-side portion without noticeable pressure, such that there is no spraying of the water. Other designs for a laminar jet regulator, for instance a lattice or mesh arrangement, perforated-plate arrangement or the like, can come into consideration equally for the laminar jet regulator portion.

In one preferred embodiment, the guide portion has a plurality of longitudinal ribs that are arranged on the housing inner wall and widen preferably in their radial extent in the direction of flow. These longitudinal ribs bring about gradual deceleration of the rotational movement of the stream of water and the latter is guided in an axial direction, following the course of the ribs, preferably as far as the laminar jet regulator portion.

Preferably, the expansion zone is in the form of a free zone, in which the rotationally accelerated stream of water can flow along the housing inner wall under the action of centrifugal force. Of course, it is also possible for the abovementioned ribs to extend out of the subsequent guide portion, with further narrowing of their radial extent, into the expansion zone. In this case, although the stream of water might not flow fully along the housing inner wall and would already be decelerated slightly in the peripheral region in the expansion zone—the function of the jet regulator and especially of the expansion zone, in which a cyclonic flow can form, would still exist.

In another development of the invention, a gas discharge pipe opens out in the free zone of the jet regulator. By way of said pipe, the gas/steam that emerges upon expansion of the pressurized, boiling water can be discharged in a targeted manner. The gas discharge pipe can in this case extend for example in an axial direction centrally through the jet regulator as far as the outlet opening, such that the steam that arises emerges on the centerline in the region of the outlet opening of the jet regulator, while the water jet flow out in an outer ring region of the outlet opening.

Alternatively, the gas discharge pipe can also extend transversely through the expansion zone as far as the housing inner wall and from there in an axial direction as far as the outlet direction. In this case, the steam is dispensed in a peripheral region of the jet regulator.

In a further embodiment, it is possible for one or more gas discharge channels that extend radially in the direction of the housing inner wall and lead from there along or within the housing inner wall as far as the outlet opening to be provided in a region above the free zone.

In this embodiment, the steam that arises is thus initially guided upward (with or without an axial gas discharge pipe) counter to the direction of flow of the water jet and from there, at the periphery of the jet regulator, to the outlet opening thereof.

In a preferred configuration, the swirl creating portion can be formed by at least one substantially helically extending flow channel. Upon flowing through the helical flow channel, the stream of water is rotationally accelerated. Upon emerging from the swirl creating portion, the expansion takes place. Due to the swirl, created by the helical form, in the stream of water, a cyclonic flow arises in the region of the inner wall of the jet regulator, while the gas that arises is pushed inward.

In an alternative embodiment, the swirl creating portion can also be formed by a plurality of helically extending guide vanes. The latter can create a cyclonic flow of the water jet in a similar manner.

The above-described jet regulator is used according to the invention in a fitting for dispensing boiling water and/or $CO_2$-containing water. In particular, the jet regulator can be used in fittings with different water dispensing functions—what is known as functional water. Via such a fitting, for example normal mixed water, boiling water, $CO_2$-enriched water, or filtered, cooled water, optionally also water enriched with added flavorings, can be dispensed selectively in an electronically controlled manner.

Furthermore, the present invention relates to a fitting for dispensing boiling water and/or $CO_2$-containing water, having an outflow and a mouthpiece arranged at the outflow, wherein a jet regulator of the type according to the invention has been inserted into the mouthpiece.

In a preferred embodiment, the fitting can be configured for selectively dispensing boiling water and mixed water, wherein the outflow has an inner flow path for the boiling water and an outer flow path, extending concentrically around the inner flow path, and wherein the mouthpiece receives, as first, inner jet regulator, a jet regulator of the type according to the invention such that said jet regulator is connected to the inner flow path in a fluid-conducting manner sealed with respect to the outer flow path. As a result, boiling water can flow out of the inner flow path through the jet regulator according to the invention, while mixed water is guided via the outer flow path and emerges in an annular region around the inner jet regulator. To this end, in particular the mouthpiece can have, concentrically around the inner, first jet regulator, an outer, second jet regulator, which is arranged annularly around the first jet regulator and is connected to the outer flow path in a fluid-conducting manner sealed with respect to the inner flow path.

It is particularly advantageous here for the inner, first jet regulator to project downwardly beyond the outer, second jet regulator, for example with a protrusion of 2 to 6 mm. This design measure ensures that no boiling water passes from the inner flow path into the outer flow path and can remain there. Therefore, there is no risk of a user scalding themselves when dispensing normal mixed water if boiling water was drawn shortly beforehand.

Alternatively, the flow paths for service water and boiling water can also be arranged laterally alongside one another. This results in a double outflow with two parallel flow paths.

BRIEF DESCRIPTION OF THE DRAWINGS

Further advantages and properties of the present invention will become apparent from the following description of exemplary embodiments with reference to the figures, in which.

DETAILED DESCRIPTION

Figure 1:
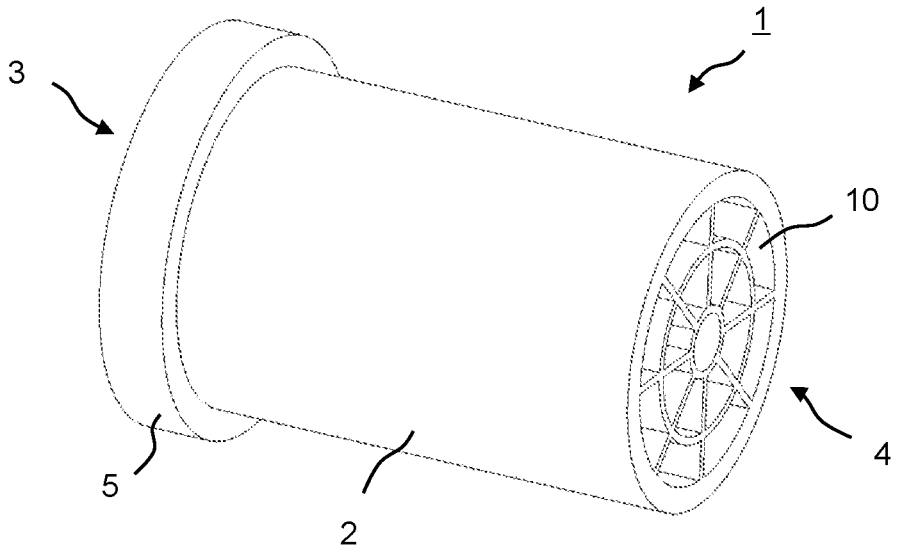
FIG. 1 shows an isometric view of a jet regulator in a first exemplary embodiment.

The jet regulator 1 shown in FIG. 1 comprises a cylindrical housing 2 with an inlet opening 3 and an outlet opening 4. Located in the region of the outlet opening 3 is a collar 5, which serves for mounting the jet regulator 1. In the region of the outlet opening 4, a laminar jet regulator portion 10 can be seen in the form of a lattice-like arrangement.

Figure 2:
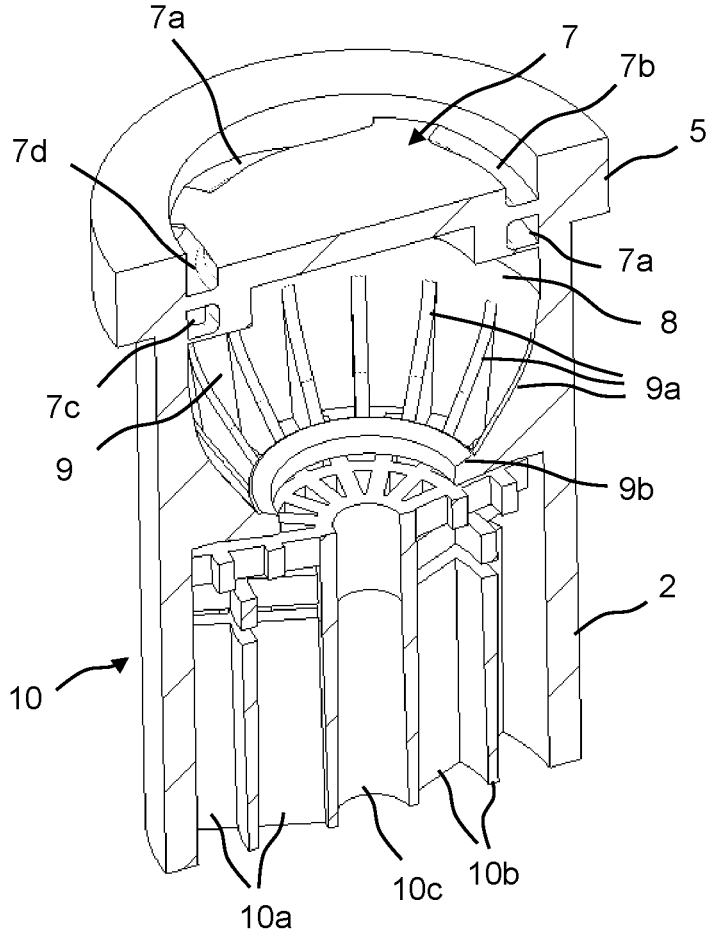
FIG. 2 shows a section in the axial direction through the jet regulator from FIG. 1.

The internal structure of the jet regulator 1 is illustrated in more detail in the sectional view in FIG. 2. Located in the region of the collar 5 is a swirl creating portion 7 having a total of four helically extending flow channels 7*a*, 7*b*, 7*c*, 7*d*, arranged in the form of a multi-start helix, which each extend through 180°, that is to say a half thread turn, along the inner wall of the cylindrical jet regulator housing 2. Otherwise, the inlet opening in the region of the swirl creating portion 7 is closed, and so the stream of water has to flow through the four flow channels 7*a* to 7*d* and in the process is rotationally accelerated. At the exit of the helically extending flow channels 7*a*, 7*b*, 7*c*, 7*d*, a free zone 8 is located within the cylindrical housing 2. In this free zone 8, expansion of the pressurized stream of liquid takes place. At the same time, the stream of water flows under the action of centrifugal force along the housing inner wall of the cylindrical housing 2. A cyclonic flow is formed, such that steam that emerges upon expansion is pushed inward into the center of the free zone 8.

The free zone 8 is adjoined in the axial direction by a guide portion 9, in which the rotational movement of the stream of water is decelerated and the latter is guided in the longitudinal direction. The guide zone 9 is characterized by a plurality of longitudinal ribs 9*a* arranged on the housing inner wall, which extend in a radial direction and the width of which, measured in the radial direction, increases in the axial direction toward the outlet opening 4. The longitudinal ribs 9*a* thus represent an obstacle, increasing in the axial direction, for the rotational movement of the stream of water, with the result that the latter is decelerated and guided in the longitudinal direction.

The longitudinal ribs 9*a* end at an annular connecting bar 9*b*, which leaves open and surrounds an inner region. This inner region serves for the water vapor formed in the free zone 8 and pushed inward to be able to escape downward in the direction of the outlet opening 4. The water flow directed in the longitudinal direction by the guide portion 9 flows through the annular space between the annular connecting piece 9*b* and the housing inner wall.

The guide portion is adjoined by the laminar jet regulator portion 10, which has a plurality of flow channels 10*a* extending in an axial direction, which are separated from one another by separating bars 10*b* that extend in a ray-like and circular manner. The water flow passes through the radially provided outer flow channels 10*a*, while the pressurized water vapor/steam emerges primarily through a centrally extending channel 10*c*.

As a result of the expansion in the free zone 8, the hot water cools rapidly to below 100° C. and reaches ambient pressure, since the following straightener and laminar jet regulator portions 8, 10 bring about only a minimal pressure drop. As a result, downstream of the free zone 8, only very few gas bubbles arise in the fluid (water). Therefore, the fluid is no longer additionally accelerated and/or turbulent and emerges as a gentle, laminar jet.

Figure 3:
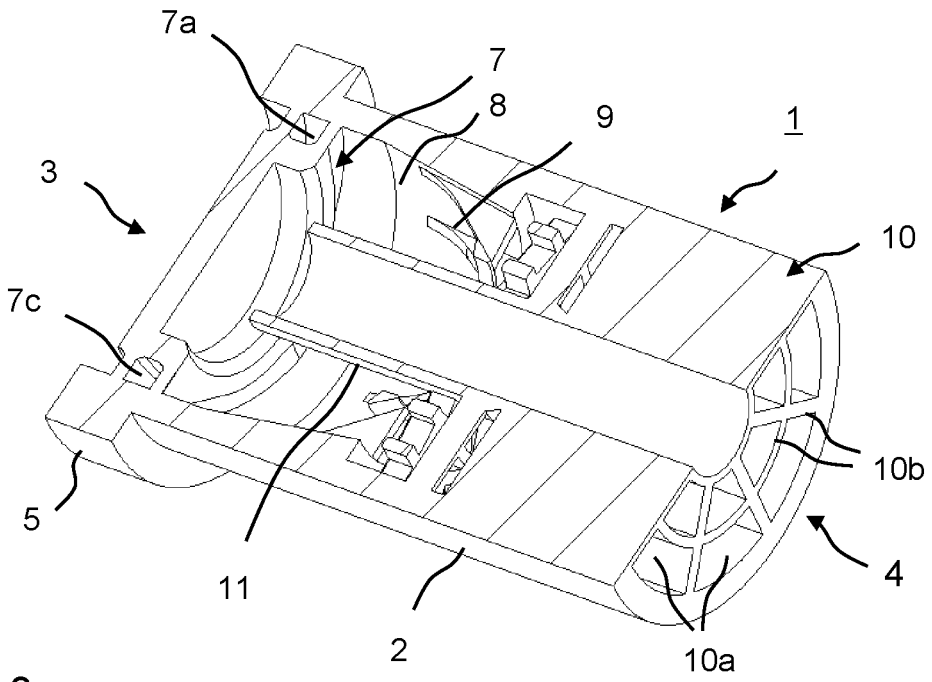
FIG. 3 shows a jet regulator in section in a second exemplary embodiment.
Figure 4:
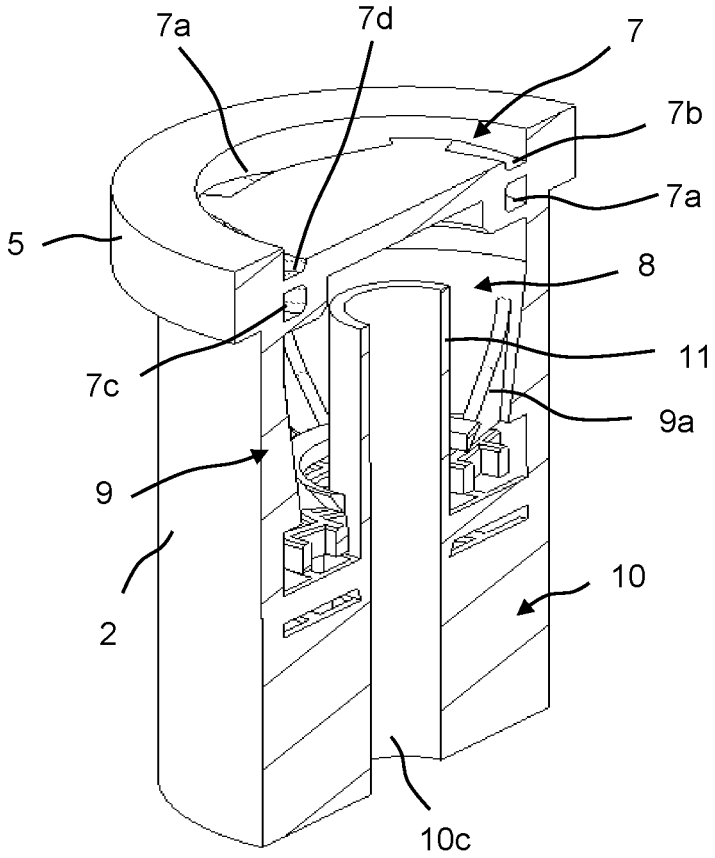
FIG. 4 shows a view of the jet regulator in section from FIG. 3 in a different view.

FIGS. 3 and 4 show a second exemplary embodiment of a jet regulator. In the exemplary embodiments, identical and identically acting elements are denoted by the same reference signs.

As in the first exemplary embodiment, the jet regulator 1 also has a swirl creating portion 7 having a plurality of helically extending flow channels 7*a* to 7*d* and a free zone 8, adjoining the swirl creating portion 7, in which the pressurized liquid expands. The free zone 8 is adjoined by the guide portion 9 having the longitudinal ribs 9*a*, and by the laminar jet regulator portion 10 having its flow channels 10*a* extending in the axial direction. In contrast to the first exemplary embodiment, a gas discharge pipe 11 is additionally provided, which opens out in the free zone 8. By way of this gas discharge pipe 11, which extends centrally in the axial direction as far as the outlet opening 4, gas/steam escaping in the free zone can be discharged in a controlled manner.

The separated gas can be discharged more quickly via the gas discharge pipe and as a result the large volume increase upon evaporation of the water can be discharged very efficiently, without the fluid being accelerated. This reduces spraying of water, which could possibly be ejected together with the pressurized gas.

Figure 5:
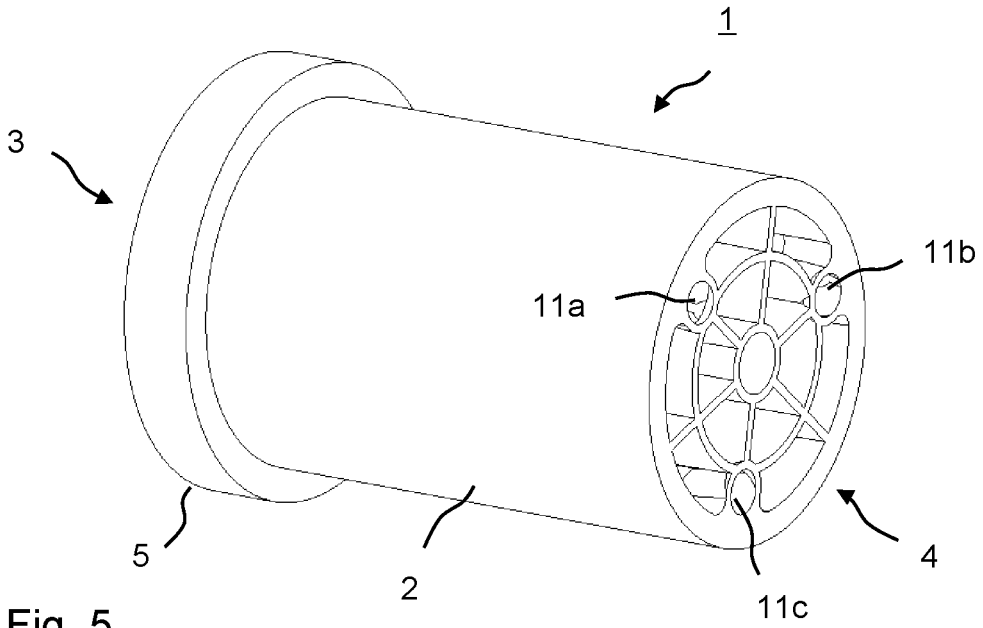
FIG. 5 shows an isometric view of a jet regulator in a third exemplary embodiment.
Figure 6:
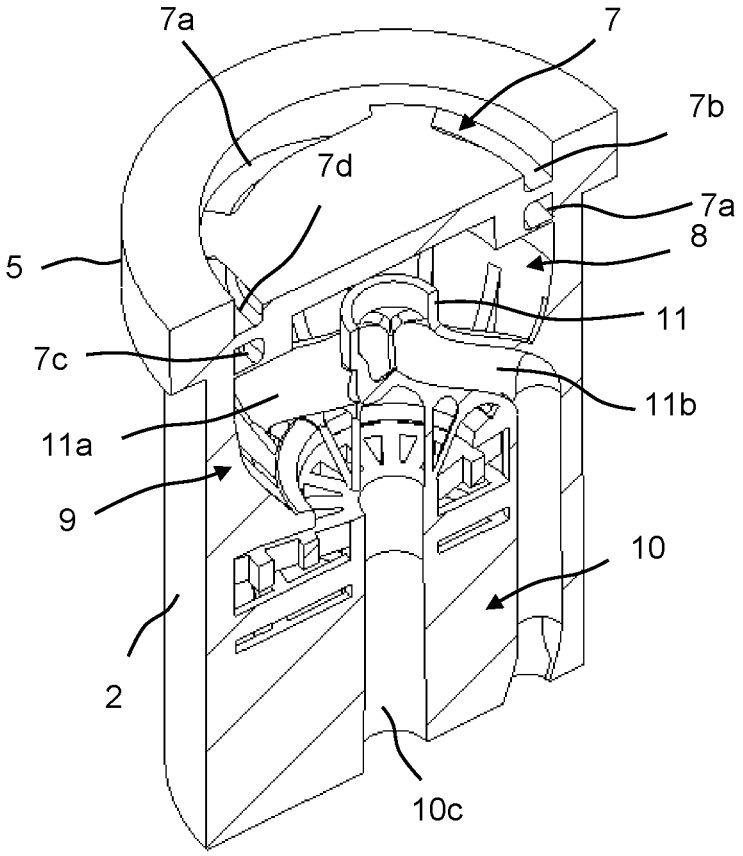
FIG. 6 shows a section through the jet regulator from FIG. 5.

FIGS. 5 and 6 show a third exemplary embodiment, in which, in contrast to the second exemplary embodiment, the gas discharge pipe opening out in the free zone 8 branches into three subpipes 11*a*, 11*b*, 11*c*, which extend transversely through the free zone 8 as far as the housing inner wall and from there along the housing inner wall in the axial direction as far as the outlet opening 4. In this way, the pressurized gas is not ejected centrally from the outlet opening 4 of the jet regulator, but rather via three separate gas outlet openings arranged in the peripheral region of the jet regulator.

Figure 7:
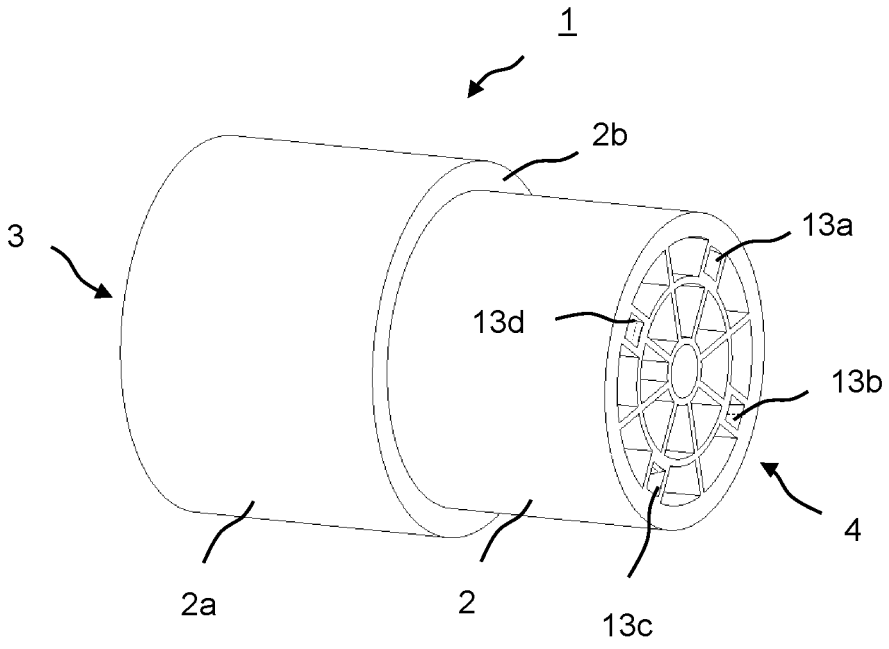
FIG. 7 shows an isometric illustration of a jet regulator in a fourth exemplary embodiment.
Figure 8:
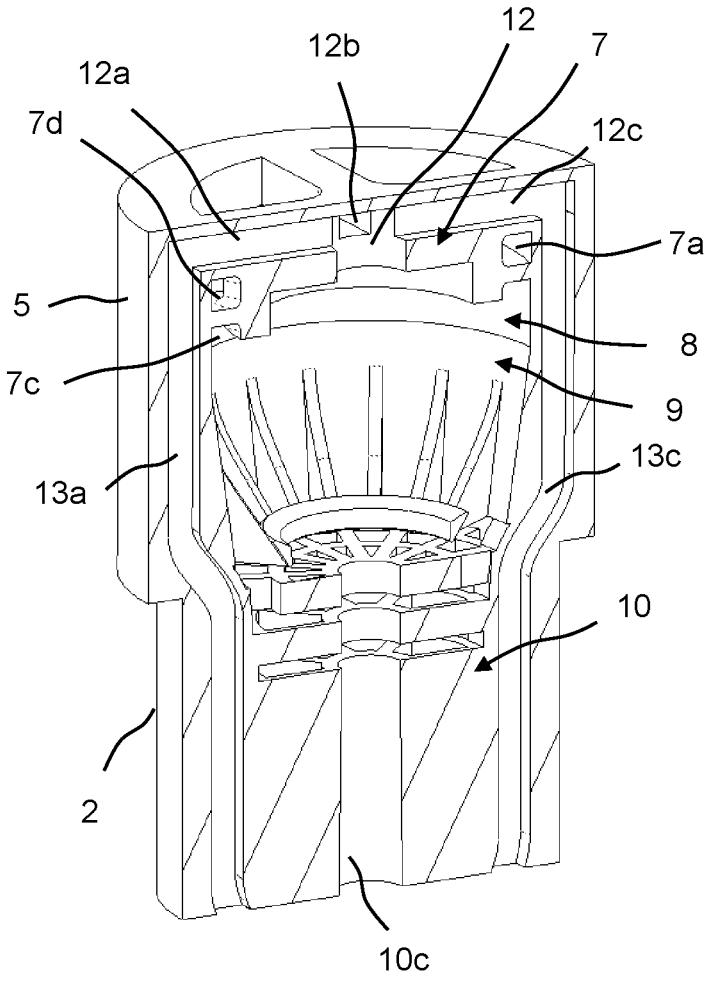
FIG. 8 shows a sectional view of the jet regulator from FIG. 7.

Finally, FIGS. 7 and 8 show a fourth exemplary embodiment. This differs from the exemplary embodiments shown above in that, rather than a gas discharge pipe centrally in the region of the swirl creating portion, an upwardly leading gas discharge opening 12 is present, which is connected to four lateral wall channels 13*a* to 13*d* via four channels 12*a* to 12*d* extending in a star shape above the swirl creating portion. The gas discharge takes place here upwardly, laterally and subsequently via the wall channels 13*a* to 13*d* in the direction of the outlet opening 4. Furthermore, the otherwise cylindrical housing 2 has, instead of a collar 5, a stepped shape, having an upper region 2*a*, with an enlarged diameter, which narrows at a step 2*b*. The stepped shape is used in this case instead of a collar 5, as in the preceding exemplary embodiments, for mounting the jet regulator 1.

Figure 9:
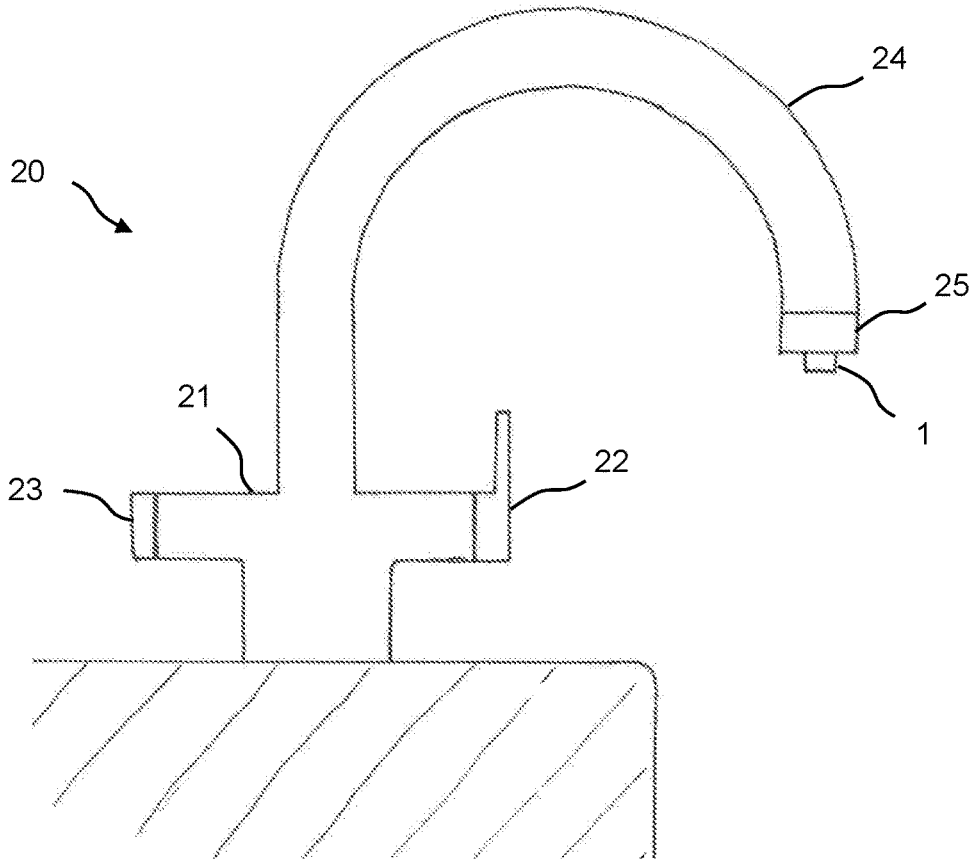
FIG. 9 shows a side view of a multifunctional fitting with an integrated jet regulator for boiling water.

An exemplary embodiment of a multifunctional fitting is reproduced in FIG. 9. The fitting 20 shown therein has a fitting body 21 with an integrated mixing valve, which is actuated in the manner of a single lever mixer via an operating lever 22 attached laterally to the fitting body 21, in order to dispense cold, hot or mixed water. Located on the opposite side of the fitting housing 21 is a further operating element 23, which is in the form of an electric rotary toggle switch. Via the latter, further functions of the fitting 20 can be controlled, for instance the dispensing of boiling water from a separate water heater connected to the fitting, the dispensing of cooled and/or $CO_2$-enriched water, or the dispensing of filtered drinking water.

Figure 10:
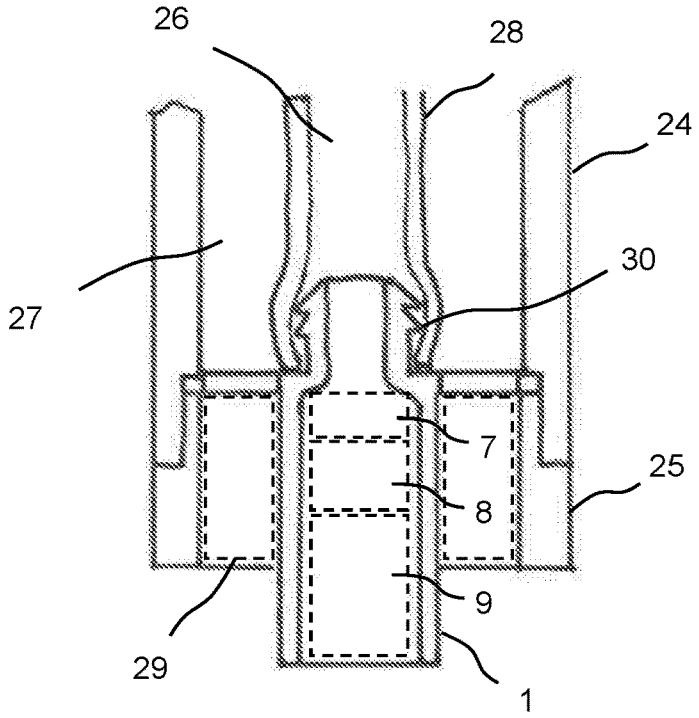
FIG. 10 shows a sectional view through the mouthpiece of the multifunctional fitting from FIG. 9.

The fitting body 21 is adjoined upwardly by an outflow 24, which extends in an arcuate manner as far as a mouthpiece 25. Via the outflow 24, both mixed water and "functional water", such as boiling water or $CO_2$-enriched water, are dispensed. For this purpose, the outflow has two coaxially arranged flow paths 26, 27, specifically, as illustrated in FIG. 10, an inner flow path 26 for "functional water" and an outer flow path 27 for normal service or mixed water. The inner flow path 26 is formed in this case by an inner pipe or hose 28 extending in the interior of the outflow 24.

Inserted concentrically into the mouthpiece 25 are two jet regulators 1, 29. The inner jet regulator 1 is connected in a fluid-conducting manner to the first flow path 26, or the inner pipe 28. The connection 30 between the inner pipe 28 and jet regulator 1 can in this case be realized for instance by a screw connection or a crimp connection. In FIG. 10, the inner jet regulator 1 is illustrated only schematically, but is provided, in the above-described design, with a swirl creating portion 7, an expansion zone 8, and a guide portion 9.

The outer jet regulator 29 arranged in an annular manner around the inner jet regulator 1 is connected in a fluid-conducting manner to the outer flow path 27 and thus has flow passing through it when service or mixed water is dispensed via the single lever mixer 22. There is no fluidic connection between the inner and outer flow paths 26, 27. Furthermore, the inner jet regulator 1 protrudes several millimeters downward beyond the mouthpiece 25. This prevents boiling water passing from the inner flow path 26 into the outer flow path 27 and being able to remain there. There is therefore no risk of scalding when a user, for example after drawing boiling water, wishes to wash their hands with mixed water.

The invention claimed is:

1. A jet regulator for a fitting for dispensing at least one of boiling water or CO2-containing water, the jet regulator comprising:

a substantially cylindrical housing having an inlet opening, an outlet opening and a housing inner wall, a swirl creating portion, arranged in a region of the inlet opening, having a substantially helically extending flow guide configured for rotationally accelerating a stream of water flowing through, an expansion zone, following the swirl creating portion, configured such that the rotationally accelerated stream of water flows due to action of centrifugal force in a region of the housing inner wall, a guide portion configured to decelerate the rotational movement of the stream of water and to guide the stream of water in a longitudinal direction, and a laminar jet regulator portion arranged in a region of the outlet opening, downstream of the guide portion, said laminar jet regulator portion having a plurality of outer flow channels configured to dispense the stream of water as a laminar jet, and said laminar jet regulator portion further having a centrally extending channel configured to dispense pressurized water vapor or steam;

wherein the guide portion has a plurality of longitudinal ribs that are arranged on the housing inner wall and widen in a radial extent in a direction of flow.

2. The jet regulator according to claim 1, further comprising a gas discharge pipe that opens out in the expansion zone.

3. The jet regulator according to claim 2, wherein the gas discharge pipe extends in an axial direction centrally through the jet regulator as far as the outlet opening.

4. The jet regulator according to claim 2, wherein the gas discharge pipe extends transversely through the expansion zone as far as the housing inner wall and from there in an axial direction as far as the outlet opening.

5. The jet regulator according to claim 1, further comprising one or more gas discharge channels that extend radially in a direction of the housing inner wall and lead from there along or within the housing inner wall as far as the outlet opening in a region above the free expansion zone.

6. The jet regulator according to claim 1, wherein the swirl creating portion has at least one substantially helically extending flow channel.

7. The jet regulator according to claim 1, wherein the swirl creating portion has a plurality of helically extending guide vanes.

8. A method of dispensing water, comprising:

providing the jet regulator according to claim 1 in a dispensing fitting, and dispensing at least one of boiling water or CO2-containing water through the jet regulator.

9. A fitting for dispensing at least one of boiling water or CO2-containing water, comprising:

an outflow, a mouthpiece arranged at the outflow, and the jet regulator according to claim 1 inserted into the mouthpiece.

10. A fitting for selectively dispensing boiling water and mixed water, the fitting comprising:

an outflow, a mouthpiece arranged at the outflow, the jet regulator according to claim 1 inserted into the mouthpiece, wherein the outflow has a first flow path for the boiling water and a second flow path for the mixed water, and the mouthpiece receives the jet regulator such that said jet regulator is connected to the first flow path in a fluid-conducting manner.

11. The fitting according to claim 10, wherein the first flow path comprises an inner flow path and the second flow path comprises an outer flow path extending concentrically around the inner flow path, and the jet regulator is comprises an inner jet regulator, which is received by the mouthpiece such that said jet regulator is connected to the inner flow path in a fluid-conducting manner sealed with respect to the outer flow path.

12. The fitting according to claim 11, wherein the mouthpiece includes, concentrically around the inner jet regulator, an outer, second jet regulator, which is arranged annularly around the inner jet regulator and is connected to the outer flow path in a fluid-conducting manner sealed with respect to the inner flow path.

13. The fitting according to claim 12, wherein the inner jet regulator.

* * * * *